US012410377B2

(12) United States Patent
Bonta et al.

(10) Patent No.: US 12,410,377 B2
(45) Date of Patent: Sep. 9, 2025

(54) ELECTRIC VEHICLE GREASE

(71) Applicant: VGP IPCO LLC, Lexington, KY (US)

(72) Inventors: Jacob Bonta, Berea, KY (US); Lucas Tomko, Lexington, KY (US)

(73) Assignee: VGP IPCO LLC, Lexington, KY (US)

( * ) Notice: Subject to any disclaimer, the term of this patent is extended or adjusted under 35 U.S.C. 154(b) by 0 days.

(21) Appl. No.: 18/300,715

(22) Filed: Apr. 14, 2023

(65) Prior Publication Data

US 2023/0332066 A1 Oct. 19, 2023

Related U.S. Application Data

(60) Provisional application No. 63/331,549, filed on Apr. 15, 2022.

(51) Int. Cl.
*C10M 169/00* (2006.01)
*C10M 101/00* (2006.01)
(Continued)

(52) U.S. Cl.
CPC ..... *C10M 169/00* (2013.01); *C10M 101/00* (2013.01); *C10M 117/00* (2013.01); *C10M 119/24* (2013.01); *C10M 133/12* (2013.01); *C10M 135/10* (2013.01); *C10M 135/18* (2013.01); *C10M 137/105* (2013.01);
(Continued)

(58) Field of Classification Search
CPC ..... C10N 2020/02; C10N 2030/02; C10N 2030/06; C10N 2030/10; C10N 2030/12; C10N 2040/02; C10N 2050/10; C10N 2030/54; C10M 169/00; C10M 101/00; C10M 117/00; C10M 119/24; C10M 133/12; C10M 135/10; C10M 135/18; C10M 137/105; C10M 141/10; C10M 145/16; C10M 161/00; C10M 2203/1006; C10M 2207/106; C10M 2209/0866; C10M 2215/26; C10M 2217/0456; C10M 2219/044; C10M 2223/047
See application file for complete search history.

(56) References Cited

U.S. PATENT DOCUMENTS 6,165,949 A 12/2000 Berlowitz et al.
8,569,216 B2 10/2013 Blain et al.
(Continued)

FOREIGN PATENT DOCUMENTS

EP 2746370 A1 6/2014
WO 2019014092 A1 1/2019

OTHER PUBLICATIONS

International Search Report and Written Opinion dated Aug. 28, 2023 for PCT Application No. PCT/US23/65768, 16 pages.
(Continued)

*Primary Examiner* — Vishal V Vasisth
(74) *Attorney, Agent, or Firm* — Benesch Friedlander Coplan & Aronoff LLP

(57) ABSTRACT

A lubricating grease for electric vehicle applications includes thickener 6% by weight (wt. %) to 12 wt. %, lubricating oil 57 wt. % to 92.98 wt. %, and surface-active ester 1 wt. % to 10 wt. %. The lubricating grease also includes additives including friction reducer and modifier 0.1 wt. % to 5 wt. %, anti-wear agent 0.1 wt. % to 5 wt. %, and a balance of extreme pressure agent, oxidation inhibitor, and corrosion inhibitor.

17 Claims, 4 Drawing Sheets

(51) Int. Cl.

| | |
|---|---|
| ***C10M 117/00*** | (2006.01) |
| ***C10M 119/24*** | (2006.01) |
| ***C10M 133/12*** | (2006.01) |
| ***C10M 135/10*** | (2006.01) |
| ***C10M 135/18*** | (2006.01) |
| ***C10M 137/10*** | (2006.01) |
| ***C10M 141/10*** | (2006.01) |
| ***C10M 145/16*** | (2006.01) |
| ***C10M 161/00*** | (2006.01) |
| *C10N 20/02* | (2006.01) |
| *C10N 30/00* | (2006.01) |
| *C10N 30/02* | (2006.01) |
| *C10N 30/06* | (2006.01) |
| *C10N 30/10* | (2006.01) |
| *C10N 30/12* | (2006.01) |
| *C10N 40/02* | (2006.01) |
| *C10N 50/10* | (2006.01) |

(52) U.S. Cl.

CPC ..... *C10M 141/10* (2013.01); *C10M 145/16* (2013.01); *C10M 161/00* (2013.01); *C10M 2203/1006* (2013.01); *C10M 2207/106* (2013.01); *C10M 2209/0866* (2013.01); *C10M 2215/26* (2013.01); *C10M 2217/0456* (2013.01); *C10M 2219/044* (2013.01); *C10M 2219/068* (2013.01); *C10M 2223/047* (2013.01); *C10N 2020/02* (2013.01); *C10N 2030/02* (2013.01); *C10N 2030/06* (2013.01); *C10N 2030/10* (2013.01); *C10N 2030/12* (2013.01); *C10N 2030/54* (2020.05); *C10N 2040/02* (2013.01); *C10N 2050/10* (2013.01)

(56) References Cited

U.S. PATENT DOCUMENTS

| | | | | |
|---|---|---|---|---|
| 2006/0263604 | A1* | 11/2006 | Martin | F16H 57/0483 428/408 |
| 2007/0149422 | A1 | 6/2007 | Miyajima et al. | |
| 2008/0004191 | A1* | 1/2008 | Ishigaki | C10M 107/28 508/172 |
| 2014/0336090 | A1 | 11/2014 | Saita et al. | |
| 2015/0376542 | A1* | 12/2015 | Yagishita | C10M 169/041 508/591 |
| 2016/0130524 | A1 | 5/2016 | Gao et al. | |
| 2019/0382680 | A1* | 12/2019 | Graham | C10M 169/06 |
| 2021/0171855 | A1* | 6/2021 | Genet | C10M 101/02 |

OTHER PUBLICATIONS

*Homo sapiens* a medium-chain fatty alcohol; HumanCYC; https://humancyc.org/compound?orgid=HUMAN&id=Medium-Chain-Alcohols, last accessed Mar. 4, 2024.

* cited by examiner

ELECTRIC VEHICLE GREASE

This application has PRO of 63/331,549, filed Apr. 15, 2022.

RELATED TECHNOLOGY

The present disclosure relates to electric vehicle grease, and more specifically relates to energy saving high efficiency lubricating grease for electric vehicle applications.

BACKGROUND

Traditional greases or lubricants are designed with the goal to optimize performance of combustion engines. For example, improving component and lubricant life may be one of the primary design metrics for lubricants used in combustion systems. With the growing demand for vehicles to transition from combustion to electric drive systems, the opportunities arise for designing lubricants that meet the high performance demands specific to electric drive systems.

SUMMARY

In one embodiment, a lubricating grease for electric vehicle applications includes thickener 6% by weight (wt. %) to 12 wt. %, lubricating oil 57 wt. % to 92.98 wt. %, and surface-active ester 1 wt. % to 10 wt. %. The lubricating grease also includes additives including friction reducer and modifier 0.1 wt. % to 5 wt. %, anti-wear agent 0.1 wt. % to 5 wt. %, and a balance of extreme pressure agent, oxidation inhibitor, and corrosion inhibitor.

A method of lubricating components in an electric vehicle includes applying a lubricating grease in the components in the electric vehicle. The lubricating grease includes thickener 6% by weight (wt. %) to 12 wt. %, lubricating oil 57 wt. % to 92.98 wt. %, and surface-active ester 1 wt. % to 10 wt. %. The lubricating grease also includes additives including friction reducer and modifier 0.1 wt. % to 5 wt. %, anti-wear agent 0.1 wt. % to 5 wt. %, and a balance of extreme pressure agent, oxidation inhibitor, and corrosion inhibitor.

DETAILED DESCRIPTION

Figure 1:
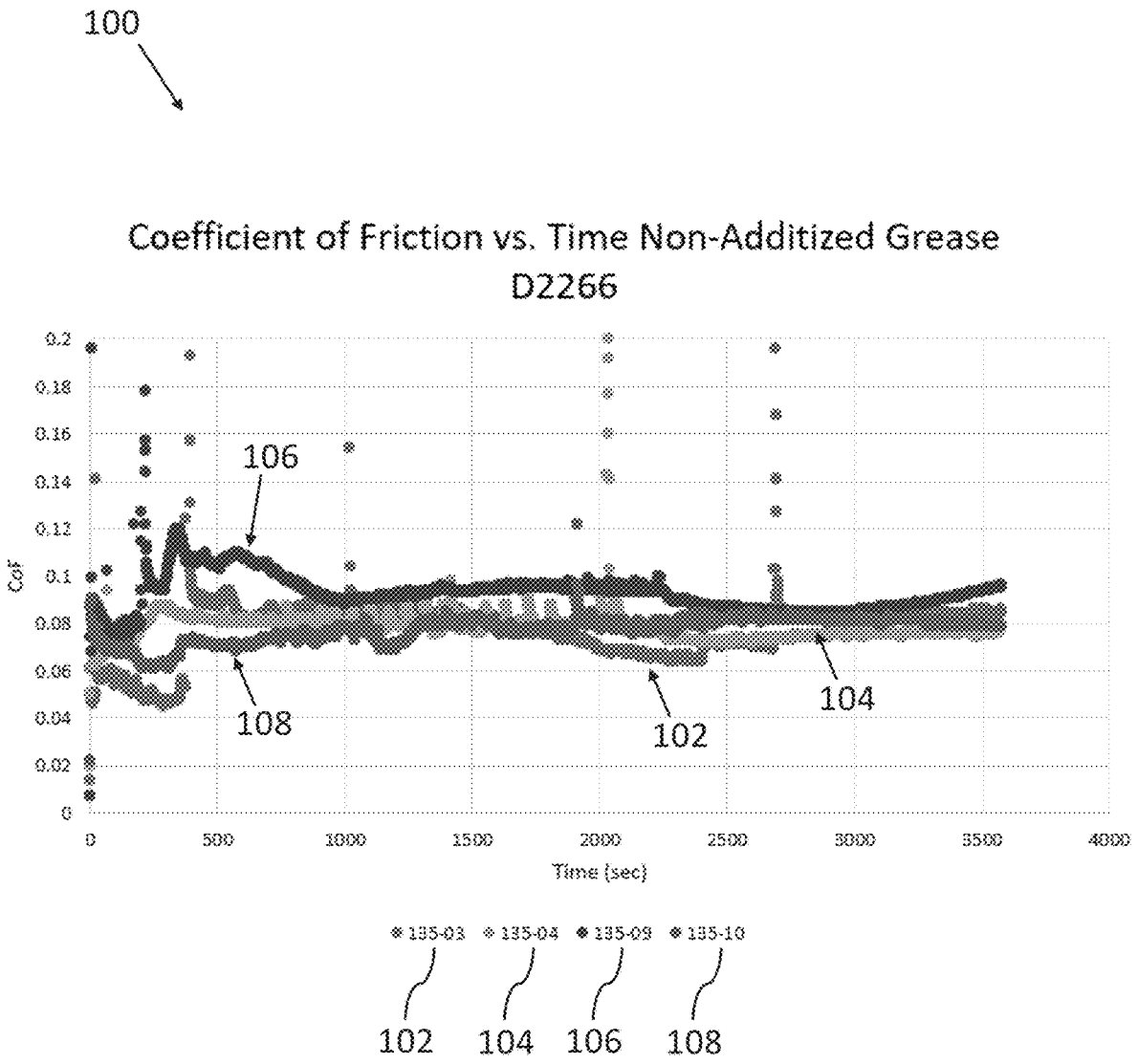
FIG. 1 shows a comparison between measured coefficient of friction values of non-additized lubricating greases.

With the transition of vehicles from combustion to electric drive systems, the opportunities for energy savings with respect to lubricants shift from combustion engine oils to grease lubricated components such as wheel bearings, constant velocity joints, universal joints, and E-motor bearings. Traditional greases for these components have been designed with the goal to optimize component life and lubricant life as the primary metrics of performance. Different from the traditional greases, energy efficiency is a significant driver for products in the electric vehicle (EV) space.

The high efficiency nature of EV grease disclosed herein is achieved by leveraging two factors: oil viscosity and frictional properties.

Reduction in oil viscosity improves efficiency until viscosity becomes too low to provide sufficient load carrying ability. This hurdle can be overcome by unique use of small amounts of a medium viscosity, highly surface-active ester oil. The addition of the high surface-active ester oil allows the reduction of the lubricating grease's bulk viscosity to extremely low levels, for example Kinematic Viscosity at 100 degrees Celsius (KV100) less than 2 cSt (centi-Stoke or $mm^2/s$) and KV at 40 degrees Celsius (KV400) less than 10 cSt, while providing sufficient film thickness to support component life. Reduction of the bulk viscosity reduces energy losses to displacement and churning of the lubricant in the bearing contacts thus improves efficiency.

In addition, friction in the lubricated system disclosed herein can be further reduced by unique application of additives designed to provide efficiencies in other applications (e.g., engine oils) as well as additives unique to grease usage. Careful balancing of these surface-active materials allows one to design the system with the lowest possible frictional properties. The synergistic effects of these approaches enable the design of greases with superior efficiency in EV applications. In one embodiment, the lubricating grease disclosed herein when subjected to field testing against materials designed for racing applications shows gains of up to 10% power savings per lubricated component (e.g., 1% to 10%, 2% to 10%, 4% to 10%, 6% to 10%, 8% to 10%).

Formulation of the Lubricating Grease

The disclosure herein provides a flexible formulations platform for the design of high-efficiency lubricating grease for EV applications. This platform is not dependent on any specific thickener or lubricating oil (e.g., base oil). Thickeners used for the formulations of lubricating grease disclosed herein may include but are not limited to lithium, lithium complex, polyurea, calcium, calcium complex, calcium sulfonate, calcium sulfonate complex, aluminum, aluminum complex, fumed silica, clay, any suitable polymeric systems, or any combinations thereof. Lubricating oils used for the formulations of lubricating grease disclosed herein are commercially available from many manufacturers and may include lubricating oils made from the API (American Petroleum Institute) groups I-V categories or any combinations thereof. Viscosity of the lubricating grease disclosed herein is characterized by the ISO viscosity classification system. Different thickener content levels can be used to achieve various National Lubricating Grease Institute (NLGI) consistency number or grade depending on the application. The NLGI consistency number expresses a measure of the relative hardness of a grease used for lubrication, as specified by the standard classification of lubricating grease established by the National Lubricating Grease Institute. The examples of the lubricating grease presented below include formulations targeting the NLGI #2 consistency grade.

Table 1 shows an example of generalized formulation of lubricating grease for electric drive systems, e.g., EV applications. The lubricating grease disclosed herein includes thickener about 6 wt. % to 12% by weight (wt. %), lubricating oil (e.g., base oil) about 57 wt. % to 92.98 wt. %, surface-active ester about 1 wt. % to 10 wt. %, friction reducer/modifier about 0.1 wt. % to 5 wt. %, anti-wear agent about 0.1 wt. % to 5 wt. %, and a balance of extreme pressure agent and corrosion/oxidation inhibitor, including extreme pressure agent about 0 wt. % to 5 wt. % oxidation inhibitor about 0 wt. % to 3 wt. %, and corrosion inhibitor about 0 wt. % to 3 wt. %.

TABLE 1

| Lubricating Grease Formulation | Weight Percent (wt. %) |
|---|---|
| Thickener | 6-12 |
| Lubricating Oil | 57-92.98 |
| Surface-active Ester | 1-10 |
| Friction Reducers/Modifier | 0.1-5 |
| Anti-wear Agent | 0.1-5 |
| Extreme Pressure Agent | 0-5 |
| Oxidation Inhibitor | 0-3 |
| Corrosion Inhibitor | 0-3 |
| Total | 100 |

The thickener in Table 1 may include lithium or lithium complex thickener, polyurea thickener, or a combination thereof.

The lubricating oil (e.g., base oil) in Table 1 may include materials from the API groups I-V categories and may be mineral or synthetic in nature. In some embodiments, the lubricating oil includes API group III or IV synthetic oils. In some embodiments, the lubricating oil includes API group IV oils of the poly-alpha olefin type. In some embodiments, the lubricating oil has a range of viscosities of KV 40=5 cSt to 150 cSt and KV 100=0.5 cSt to 25 cSt. In some embodiments, the lubricating oil has viscosities of KV 40=about 10 cSt and KV 100=about 2 cSt.

The lubricating oil may be composed of a single viscosity grade (VG) under the ISO viscosity classification (ISO 3448 viscosity classification) or blends of viscosity grades to achieve the desired viscosity level. As an example, the lubricating oil may include ISO VG 10 lubricating boil, ISO VG 68 lubricating boil, ISO VG 150 lubricating oil, or any combinations thereof. ISO VG 10 refers to a viscosity grade of 10 cSt±10% at 40° C. ISO VG 68 refers to a viscosity grade of 68 cSt±10% at 40° C. ISO VG 150 refers to a viscosity grade of 150 cSt±10% at 40° C. Any viscosity can be obtained with a mixture of ISO VG lubricating oils, for example, ISO VG 10, 15, 22, 32, 46, 68, 100, 150, 220, etc. As an example, the lubricating oil may be an ISO VG 150 Group I/II/V mineral oil blend, ISO VG 68 Group I/II/V mineral oil blend, ISO VG 10 Group I/II/V mineral oil blend, ISO VG 150 Group III/IV synthetic oil blend, ISO VG 68 Group III/IV synthetic oil blend, or ISO VG 10 Group III/IV synthetic oil blend.

The surface-active ester in Table 1 is a synthetic copolymer of alpha-olefins and dicarboxylic acids which are esterified with short to medium chain alcohols. As a result, the surface-active ester in Table 1 is an oil with a carbon backbone with two distinct side chains. The first side chain is composed of carbon atoms that improves the hydrophobicity of the material and the compatibility with lubricating oils. The second side chain is composed of ester side groups. The second side chain gives the oil a strongly polar character, providing the high surface activity and affinity for polar surfaces such as metals (steel, aluminum, etc.) and metal alloys. The surface-active ester disclosed herein may vary significantly in viscosity. In some embodiments, the surface-active ester used in formulations shown in Table 1 may have viscosities of KV 40=75 cSt to 800 cSt and KV 100=10 cSt to 75 cSt. In some embodiments, the surface-active ester used in formulations shown in Table 1 may have viscosities of KV 40=200 cSt to 400 cSt and KV 100=15 cSt to 40 cSt. The inclusion of low concentrations of medium viscosity surface active ester(s) allows for the significant reduction of the bulk oil viscosity while maintaining a critical level of tribological protection across various loads and contact conditions. As an example, the surface-active ester may be a ~300 cSt ester blend, ~200 cSt ester blend, ~100 cSt ester blend.

The friction reducer/modifier (friction reducing/modifying agent) in Table 1 are materials requiring low or zero ambient energy conditions to form tribological films on surfaces. The friction reducer/modifier typically work by physical adsorption to the surfaces but can also be chemically activated/reacted with surfaces as is seen with other tribological agents. The friction reducer/modifier may include lubricating greases used in engine lubricants. The friction reducer/modifier are employed in formulations in Table 1 to lower the friction present between surfaces in relative motion and provide benefits related to wear, operating temperatures, and energy usage. The chemistries used in formulating the friction reducer/modifier of Table 1 can be of the ashless (no metal ions), ash (with metal ions) varieties, or others. The friction reducer/modifier in Table 1 may include the following materials or combinations thereof: organic modifiers (long chain esters, alkanolamindes and variations based on C, N, O and H elements), molybdenum dialkyldithiophosphates and derivatives, molybdenum dithiocarbamates and derivatives, antimony dithiocarbamates, dimercaptothiadiazoles and derivatives, tungsten dialkyldithiophosphates and derivatives, ashless phosphorodithioates, amine phosphates and derivatives, molybdenum dithiocarbamate alkanoamide, antimony dithocarbamate organic long chain ester.

The anti-wear agent in Table 1 are materials requiring low or moderate energy conditions to activate and form tribological films on surfaces. The anti-wear agent of Table 1 may include compounds that are typically used in lubricating greases for various applications and are employed to reduce the wear rates between surfaces in relative motion. The chemistries used in formulating the anti-wear agent in Table 1 can be of the ashless (no metal ions), ash (with metal ions) varieties, or others. The anti-wear agent of Table 1 may include the following materials or combinations thereof: zinc dithiophosphate, ZDDP (primary, secondary, mixed), amine sulfurized dithiophosphates, polysulfides, phosphoric acid esters, dialkyldithiocarbamates, dialkylammonium tungstates, borate esters, amine phosphates, and organosulfur-phosphates.

The extreme pressure agent in Table 1 are materials typically requiring high energy conditions to activate and form tribological films on surfaces or may alternatively be solid particles dispersed into lubricating greases that physically separate tribological contacts. The extreme pressure agent in Table 1 may include compounds that are commonly used in lubricating greases in various applications and are employed to provide tribological protect in extreme conditions of loading in bearings or other greased contacts. The chemistries used in formulating the extreme pressure agent in Table 1 can be of the ashless (no metal ions), ash (with metal ions) varieties, or others. The extreme pressure agent of Table 1 may include the following materials or combinations thereof: calcium carbonates, molybdenum disulfides, dithiophosphates, amine sulfurized phosphates/phosphites, sulfurized isobutylene and derivatives, sulfurized olefins and derivatives, sodium/potassium borate salts, zinc dithiophosphates, sulfurized fatty acid esters, sulfurized triglycerides, dialkylpentasulfides, antimony dialkyldithiocarbamates and derivatives, amine phosphates and derivatives, thiadiazole derivatives, organic dibutyldithiocarbamates and derivatives, calcium sulfonates and derivatives.

The corrosion and oxidation inhibitor in Table 1 may include common materials used to improve the protective qualities and extend the useful lifetime of lubricating greases under various conditions. The oxidation inhibitor of Table 1 may include the following materials or combinations thereof: phenolic, phenolic antioxidants, aryl amines, and butylated phenols.

The corrosion inhibitor of Table 1 may include the following materials or combinations thereof: fatty acid amine, amine carboxylates, borate caboxylates, alkyl phosphates, pyridine benzyl quaternary ammonium compounds, imidazolines, calcium sulfonates, 400 TBN calcium sulfonate (e.g., TBN 400 mg KOH/g), hydroxy-amino phosphoric acids, benzotriazole/tolytriazoles. In some embodiments, the formulation in Table 1 excludes corrosion and/or oxidation inhibitors.

Tables 2-7 below show example formulations of lubricating grease for electric drive systems. In Formulation Nos. 1-3, lithium/lithium complex thickener and mineral lubricating oil (ISO VG 150, ISO VG 68, and ISO VG 10; Group I/II/V) are used. In Formulation Nos. 4-6, lithium/lithium complex thickener and synthetic lubricating oil (ISO VG 150, ISO VG 68, and ISO VG 10; Group III/IV) are used.

TABLE 2

| Formulation No. 1 | Component | wt. % |
|---|---|---|
| Thickener | Lithium/Lithium Complex Thickener | 10 |
| Lubricating Oil | ISO VG 150 Group I/II/V Mineral Oil Blend | 80.5 |
| Surface Active Ester | ~300 cSt Ester Blend | 3 |
| Friction Reducer/modifier | Molybdenum dialkyldithiophosphate | 2 |
| Anti-wear Agent | Organo-sulfur Phosphate | 1.5 |
| Extreme Pressure Agent | Calcium Carbonate | 2 |
| Oxidation Inhibitor | Phenolic | 0.5 |
| Corrosion Inhibitor | Fatty Acid Amine | 0.5 |

TABLE 3

| Formulation No. 2 | Component | wt. % |
|---|---|---|
| Thickener | Lithium/Lithium Complex Thickener | 10 |
| Lubricating Oil | ISO VG 68 Group I/II/V Mineral Oil Blend | 77.5 |
| Surface Active Ester | ~200 cSt Ester Blend | 5 |
| Friction Reducer/modifier | Molybdenum Dithiocarbamate | 1.5 |
| | Alkanoamide | 1.5 |
| Anti-wear Agent | Dialkyldithiocarbamate | 1.5 |
| Extreme Pressure Agent | Amine Sulfurized Phosphate | 2 |
| Oxidation Inhibitor | Aryl Amine | 0.5 |
| Corrosion Inhibitor | Amine Carboxylate | 0.5 |

TABLE 4

| Formulation No. 3 | Component | wt. % |
|---|---|---|
| Thickener | Lithium/Lithium Complex Thickener | 10 |
| Lubricating Oil | ISO VG 10 Group I/II/V Mineral Oil Blend | 74.5 |
| Surface Active Ester | ~100 cSt Ester Blend | 8 |
| Friction Reducer/modifier | Antimony Dithocarbamate, | 2 |
| | Organic long chain ester | 1 |
| Anti-wear Agent | Dialkyldithiocarbamates | 1.5 |
| Extreme Pressure Agent | Dithiophosphate | 1 |

TABLE 4-continued

| Formulation No. 3 | Component | wt. % |
|---|---|---|
| Oxidation Inhibitor | Aryl Amine | 1 |
| Corrosion Inhibitor | 400 TBN Calcium Sulfonate | 1 |

TABLE 5

| Formulation No. 4 | Component | wt. % |
|---|---|---|
| Thickener | Lithium/Lithium Complex Thickener | 10 |
| Lubricating Oil | ISO VG 150 Group III/IV Synthetic Oil Blend | 80.5 |
| Surface Active Ester | ~300 cSt Ester Blend | 3 |
| Friction Reducer/modifier | Molybdenum dialkyldithiophosphate | 2 |
| Anti-wear Agent | Organo-sulfur Phosphate | 1.5 |
| Extreme Pressure Agent | Calcium Carbonate | 2 |
| Oxidation Inhibitor | Phenolic | 0.5 |
| Corrosion Inhibitor | Fatty Acid Amine | 0.5 |

TABLE 6

| Formulation No. 5 | Component | wt. % |
|---|---|---|
| Thickener | Lithium/Lithium Complex Thickener | 10 |
| Lubricating Oil | ISO VG 68 Group III/IV Synthetic Oil Blend | 77.5 |
| Surface Active Ester | ~200 cSt Ester Blend | 5 |
| Friction Reducer/modifier | Molybdenum Dithiocarbamate | 1.5 |
| | Alkanoamide | 1.5 |
| Anti-wear Agent | Dialkyldithiocarbamate | 1.5 |
| Extreme Pressure Agent | Amine Sulfurized Phosphate | 2 |
| Oxidation Inhibitor | Aryl Amine | 0.5 |
| Corrosion Inhibitor | Amine Carboxylate | 0.5 |

TABLE 7

| Formulation No. 6 | Component | wt. % |
|---|---|---|
| Thickener | Lithium/Lithium Complex Thickener | 10 |
| Lubricating Oil | ISO VG 10 Group III/IV Synthetic Oil Blend | 74.5 |
| Surface Active Ester | ~100 cSt Ester Blend | 8 |
| Friction Reducer/modifier | Antimony Dithocarbamate, | 2 |
| | Organic long chain ester | 1 |
| Anti-wear Agent | Dialkyldithiocarbamates | 1.5 |
| Extreme Pressure Agent | Dithiophosphate | 1 |
| Oxidation Inhibitor | Aryl Amine | 1 |
| Corrosion Inhibitor | 400 TBN Calcium Sulfonate | 1 |

Tables 8-13 below show example formulations of lubricating grease for electric drive systems. In Formulation Nos. 7-9, polyurea thickener and mineral lubricating oil (ISO VG 150, ISO VG 68, and ISO VG 10; Group I/II/V) are used. In Formulation Nos. 10-12, polyurea thickener and synthetic lubricating oil (ISO VG 150, ISO VG 68, and ISO VG 10; Group III/IV) are used.

TABLE 8

| Formulation No. 7 | Component | wt. % |
|---|---|---|
| Thickener | Polyurea Thickener | 10 |
| Lubricating Oil | ISO VG 150 Group I/II/V Mineral Oil Blend | 80.5 |

TABLE 8-continued

| Formulation No. 7 | Component | wt. % |
|---|---|---|
| Surface Active Ester | ~300 cSt Ester Blend | 3 |
| Friction Reducer/modifier | Molybdenum dialkyldithiophosphate | 2 |
| Anti-wear Agent | Organo-sulfur Phosphate | 1.5 |
| Extreme Pressure Agent | Calcium Carbonate | 2 |
| Oxidation Inhibitor | Phenolic | 0.5 |
| Corrosion Inhibitor | Fatty Acid Amine | 0.5 |

TABLE 9

| Formulation No. 8 | Component | wt. % |
|---|---|---|
| Thickener | Polyurea Thickener | 10 |
| Lubricating Oil | ISO VG 68 Group I/II/V Mineral Oil Blend | 77.5 |
| Surface Active Ester | ~200 cSt Ester Blend | 5 |
| Friction Reducer/modifier | Molybdenum Dithiocarbamate | 1.5 |
| | Alkanoamide | 1.5 |
| Anti-wear Agent | Dialkyldithiocarbamate | 1.5 |
| Extreme Pressure Agent | Amine Sulfurized Phosphate | 2 |
| Oxidation Inhibitor | Aryl Amine | 0.5 |
| Corrosion Inhibitor | Amine Carboxylate | 0.5 |

TABLE 10

| Formulation No. 9 | Component | wt. % |
|---|---|---|
| Thickener | Polyurea Thickener | 10 |
| Lubricating Oil | ISO VG 10 Group I/II/V Mineral Oil Blend | 74.5 |
| Surface Active Ester | ~100 cSt Ester Blend | 8 |
| Friction Reducer/modifier | Antimony Dithocarbamate, | 2 |
| | Organic long chain ester | 1 |
| Anti-wear Agent | Dialkyldithiocarbamates | 1.5 |
| Extreme Pressure Agent | Dithiophosphate | 1 |
| Oxidation Inhibitor | Aryl Amine | 1 |
| Corrosion Inhibitor | 400 TBN Calcium Sulfonate | 1 |

TABLE 11

| Formulation No. 10 | Component | wt. % |
|---|---|---|
| Thickener | Polyurea Thickener | 10 |
| Lubricating Oil | ISO VG 150 Group III/IV Synthetic Oil Blend | 80.5 |
| Surface Active Ester | ~300 cSt Ester Blend | 3 |
| Friction Reducer/modifier | Molybdenum dialkyldithiophosphate | 2 |
| Anti-wear Agent | Organo-sulfur Phosphate | 1.5 |
| Extreme Pressure Agent | Calcium Carbonate | 2 |
| Oxidation Inhibitor | Phenolic | 0.5 |
| Corrosion Inhibitor | Fatty Acid Amine | 0.5 |

TALBE 12

| Formulation No. 11 | Component | wt. % |
|---|---|---|
| Thickener | Polyurea Thickener | 10 |
| Lubricating Oil | ISO VG 68 Group III/IV Synthetic Oil Blend | 77.5 |
| Surface Active Ester | ~200 cSt Ester Blend | 5 |
| Friction Reducer/modifier | Molybdenum Dithiocarbamate | 1.5 |
| | Alkanoamide | 1.5 |
| Anti-wear Agent | Dialkyldithiocarbamate | 1.5 |
| Extreme Pressure Agent | Amine Sulfurized Phosphate | 2 |
| Oxidation Inhibitor | Aryl Amine | 0.5 |
| Corrosion Inhibitor | Amine Carboxylate | 0.5 |

TABLE 13

| Formulation No. 12 | Component | wt. % |
|---|---|---|
| Thickener | Polyurea Thickener | 10 |
| Lubricating Oil | ISO VG 10 Group III/IV Synthetic Oil Blend | 74.5 |
| Surface Active Ester | ~100 cSt Ester Blend | 8 |
| Friction Reducer/modifier | Antimony Dithocarbamate, | 2 |
| | Organic long chain ester | 1 |
| Anti-wear Agent | Dialkyldithiocarbamates | 1.5 |
| Extreme Pressure Agent | Dithiophosphate | 1 |
| Oxidation Inhibitor | Aryl Amine | 1 |
| Corrosion Inhibitor | 400 TBN Calcium Sulfonate | 1 |

Test Results

The formulations of the lubricating grease shown in Table 1 are subjected to tribological tests according to the ASTM D5706, ASTM D2266, and ASTM D 2596 standards. As an example, Formulation Nos. 13-16 are subjected to the tribological tests. Formulation No. 13 includes an ISO VG 150 lubricating oil while Formulation No. 14 includes both an ISO VG 150 lubricating oil and a surface-active ester. Specifically, Formulation No. 14 is identical to Formulation No. 4, and Formulation No. 13 is shown in Table 14.

Formulation No. 15 includes an ISO VG 10 lubricating oil, and Formulation No. 16 includes both an ISO VG 10 lubricating oil and a surface-active ester. Specifically, Formulation No. 16 is identical to Formulation No. 6, and Formulation No. 15 is shown in Table 15.

In each of the Formulation Nos. 13-16, the lubricating oil may be about 75 wt. % to about 95 wt. % and the surface-active ester may be about 0.1 wt. % to about 15 wt. %.

TABLE 14

| Formulation No. 13 | Component | wt. % |
|---|---|---|
| Thickener | Lithium/Lithium Complex Thickener | 10.31 |
| Lubricating Oil | ISO VG 150 Group III/IV Synthetic Oil Blend | 82.9 |
| Surface Active Ester | — | 0 |
| Friction Reducer/modifier | Molybdenum dialkyldithiophosphate | 2.1 |
| Anti-wear Agent | Organo-sulfur Phosphate | 1.55 |
| Extreme Pressure Agent | Calcium Carbonate | 2.1 |
| Oxidation Inhibitor | Phenolic | 0.52 |
| Corrosion Inhibitor | Fatty Acid Amine | 0.52 |

TABLE 15

| Formulation No. 15 | Component | wt. % |
|---|---|---|
| Thickener | Lithium/Lithium Complex Thickener | 10.9 |
| Lubricating Oil | ISO VG 10 Group III/IV Synthetic Oil Blend | 80.9 |
| Surface Active Ester | — | 0 |
| Friction Reducer/modifier | Antimony Dithocarbamate, | 2.1 |
| | Organic long chain ester | 1.1 |
| Anti-wear Agent | Dialkyldithiocarbamates | 1.6 |
| Extreme Pressure Agent | Dithiophosphate | 1.1 |
| Oxidation Inhibitor | Aryl Amine | 1.1 |
| Corrosion Inhibitor | 400 TBN Calcium Sulfonate | 1.1 |

Table 14 shows example test results of Formulation Nos. 13-16. The ASTM D5706 test results in Table 16 are values in standard SI units. The ASTM D2266 test results in Table 16 are average size of the scars in millimeters (mm). The ASTM D2596 test results in table 16 are the Last Non-Seizure Load (LNSL) and Weld Point (WP) in kilogram (kg).

TABLE 16

| Formulation No. | Materials | D5706 | D2266 (mm) | D2596 (kg, LSNL/WP) |
|---|---|---|---|---|
| 13 | ISO 150 | 850 | 0.455 | 100/400 |
| 14 | ISO 150 + Ester | 1250 | 0.429 | 100/400 |
| 15 | ISO 10 | 1633 | 0.853 | 126/250 |
| 16 | ISO 10 + Ester | 2000 | 0.553 | 160/315 |

FIG. 1 shows a comparison between the measured coefficient of friction values of the non-additized lubricating greases of Formulation Nos. 13-16. The non-additized lubricating greases only include the thickener, the lubricating oil, and the surface-active ester (e.g., excluding the friction reducer/modifier, the anti-wear agent, the extreme pressure agent, and corrosion/oxidation inhibitor). In a coefficient of friction v.s. time plot 100, the coefficient of friction values are measured according to the ASTM D2266 standard. Series 102, 104, 106, and 108 correspond to the non-additized lubricating greases of Formulation Nos. 13-16, respectively.

Figure 2:
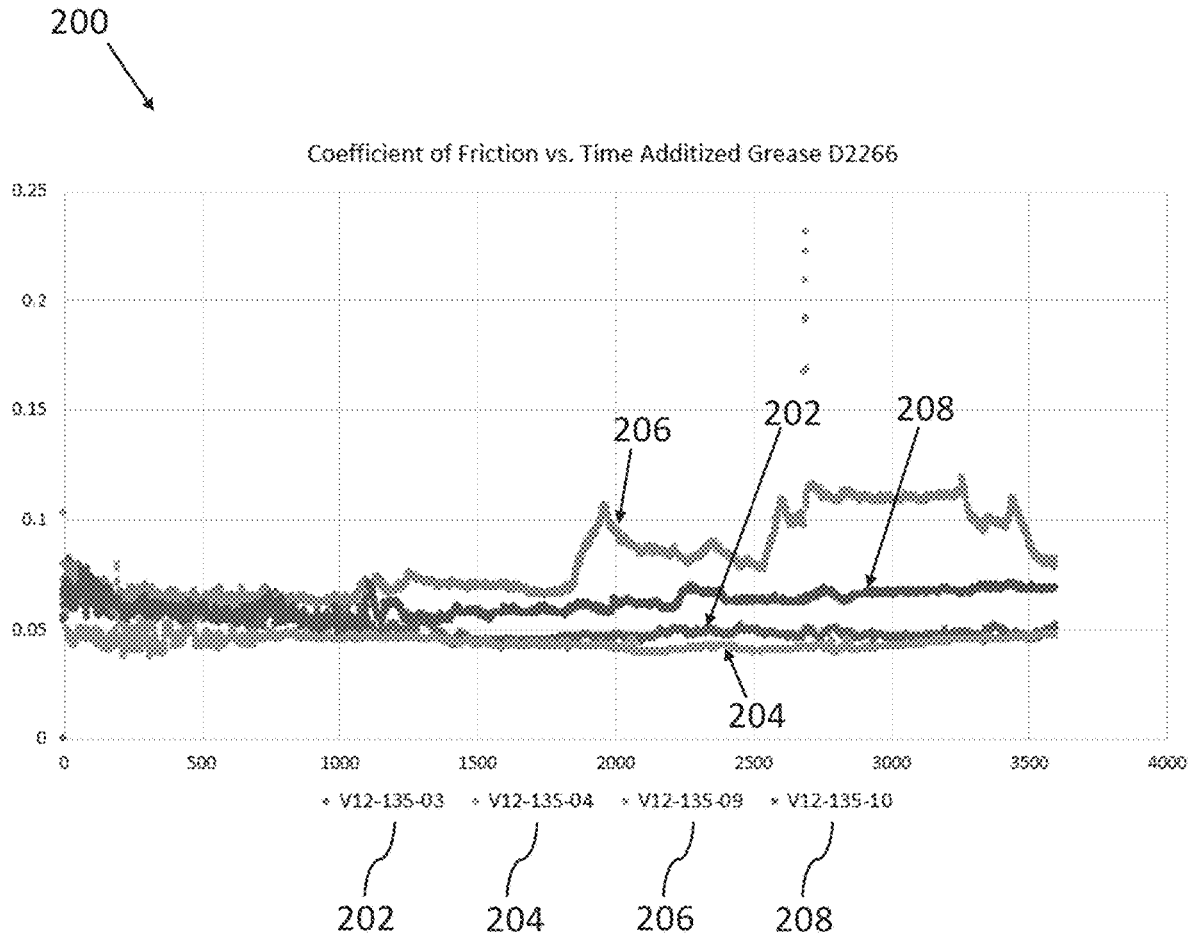
FIG. 2 shows a comparison between measured coefficient of friction values of additized lubricating greases.

FIG. 2 shows a comparison between the measured coefficient of friction values of the additized lubricating greases of Formulation Nos. 13-16. The additized lubricating greases include the lubricating oil and the surface-active ester, and at least one of the anti-wear agents, extreme pressure agents, and corrosion/oxidation inhibitors as additive(s). In a coefficient of friction v.s. time plot 200, the coefficient of friction values are measured according to the ASTM D2266 standard. Series 202, 204, 206, and 208 correspond to the additized lubricating greases of Formulation Nos. 13-176, respectively.

Figure 3:
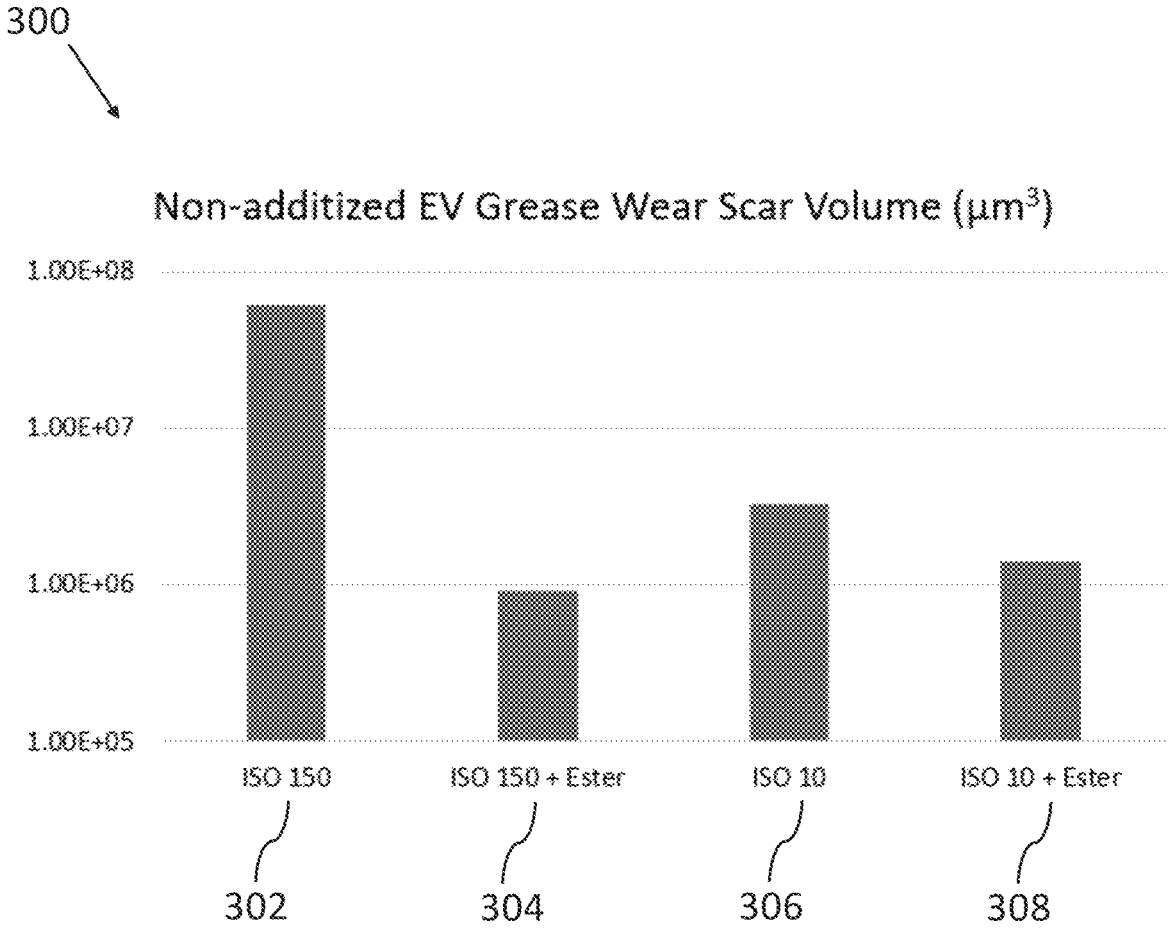
FIG. 3 shows a comparison between measured wear scar volumes of non-additized lubricating greases.

FIG. 3 shows a comparison between the measured wear scar volumes of the non-additized lubricating greases of Formulation Nos. 13-16. The non-additized lubricating greases only include the lubricating oil and the surface-active ester (e.g., excluding the anti-wear agents, extreme pressure agents, and corrosion/oxidation inhibitors). The wear scar volumes are measured according to the ASTM D2266 standard and are presented in micrometers (μm). In a plot 300, series 302, 304, 306, and 308 correspond to the non-additized lubricating greases of Formulation Nos. 13-16, and the measured scar volumes are $6.02\times10^7$ μm, $9.23\times10^5$ μm, $3.28\times10^6$ μm, and $1.40\times10^6$ μm, respectively. These values are plotted along the y-axis of the plot 300 on logarithmic scale of base 10.

Figure 4:
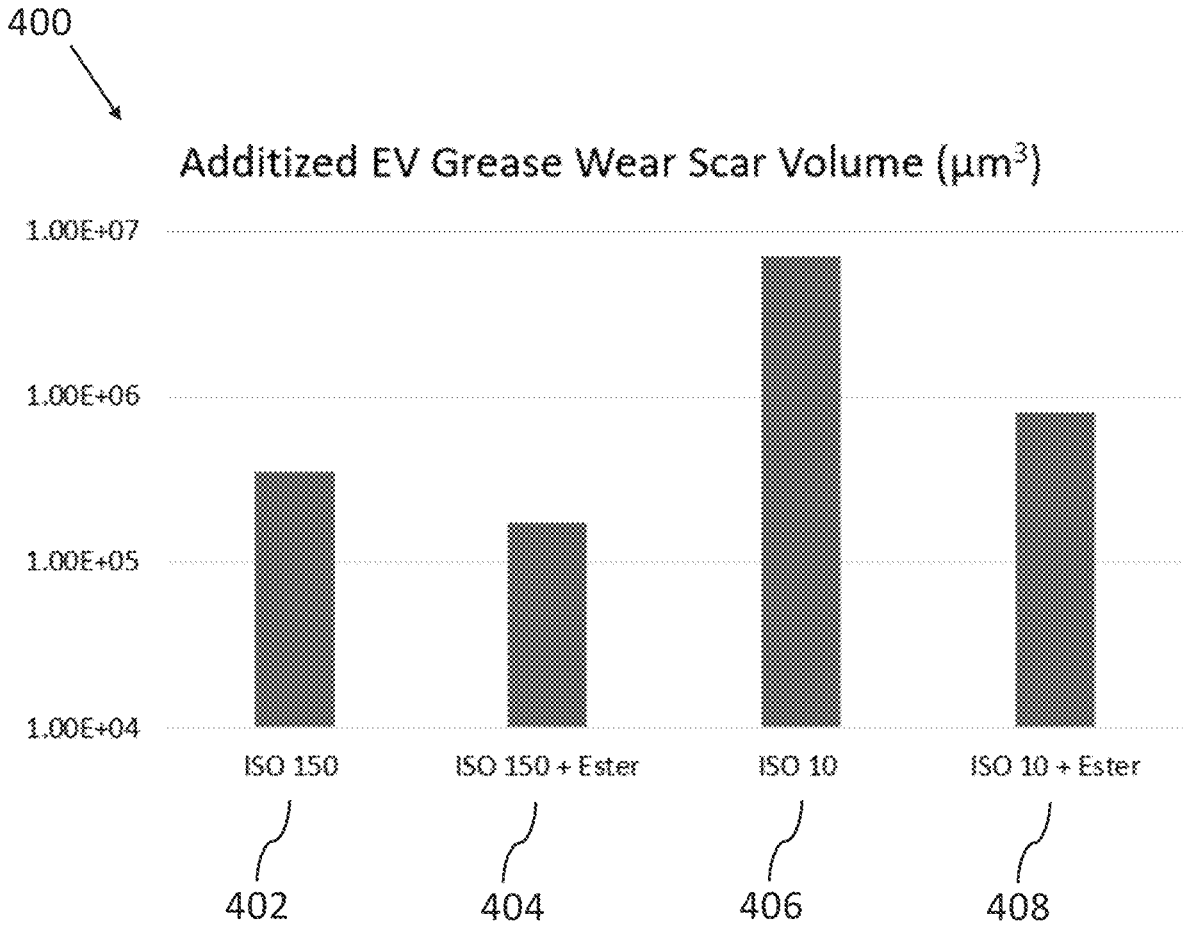
FIG. 4 shows a comparison between measured wear scar volumes of additized lubricating greases.

FIG. 4 show a comparison between the measured wear scar volumes of the additized lubricating greases of Formulation Nos. 13-16. The additized lubricating greases include the lubricating oil and the surface-active ester, and at least one of the excluding anti-wear agents, extreme pressure agents, and corrosion/oxidation inhibitors as additive(s). The wear scar volumes are measured according to the ASTM D2266 standard and are presented in micrometers (μm). In a plot 400, series 402, 404, 406, and 408 correspond to the additized lubricating greases of Formulation Nos. 13-16, and the measured scar volumes are 3.53×105 μm, 1.77×105 μm, $7.07\times10^6$ μm, and $7.95\times10^5$ μm, respectively. These values are plotted along the y-axis of the plot 400 on logarithmic scale of base 10.

The invention claimed is:

1. A lubricating grease for electric vehicle applications comprising:

a thickener in a range of 6% by weight (wt. %) to 12 wt. %;

a lubricating oil consisting of synthetic oil selected from API (American Petroleum Institute) groups III and IV in a range of 57 wt. % to 92.98 wt. %;

a surface-active ester in a range of 8 wt. % to 10 wt. %, the surface-active ester comprising a synthetic copolymer of alpha-olefins and dicarboxylic acids esterified with short to medium chain alcohols comprising about 3 to 12 carbon atoms; and an additive comprising:

a friction reducer and a modifier in a range of 0.1 wt. % to 5 wt. %;

an anti-wear agent in a range of 0.1 wt. % to 5 wt. %; and an extreme pressure agent, an oxidation inhibitor, and a corrosion inhibitor, wherein the lubricating grease is formulated to provide tribological protection for the electrical vehicle applications, and wherein the surface-active ester is an oil with a carbon backbone with two distinct side chains, the first side chain is hydrophobic, and the second side chain is polar, and wherein the lubricating oil has a bulk KV 100 of about 2 cSt or less than 2 cSt.

2. The lubricating grease of claim 1, wherein the thickener comprises lithium complex thickener.

3. The lubricating grease of claim 1, wherein the thickener comprises polyurea thickener.

4. A lubricating grease for electric vehicle applications comprising:

a thickener in a range of 6% by weight (wt. %) to 12 wt. %;

a lubricating oil in a range of 57 wt. % to 92.98 wt. %; and a surface-active ester present in an amount of 3 wt. % to 8 wt. %, the surface-active ester comprising a synthetic copolymer of alpha-olefins and dicarboxylic acids esterified with short to medium chain alcohols comprising about 3 to 12 carbon atoms, wherein the lubricating grease excludes a friction reducer and a modifier, an anti-wear agent, an extreme pressure agent, an oxidation inhibitor, and a corrosion inhibitor, and is formulated to provide tribological protection for the electrical vehicle applications, and wherein the surface-active ester is an oil with a carbon backbone with two distinct side chains, the first side chain is hydrophobic, and the second side chain is polar.

5. The lubricating grease of claim 4, wherein the lubricating grease has a bulk KV 40 less than 10 cSt and a bulk KV 100 less than 2 cSt.

6. The lubricating grease of claim 1, wherein the lubricating oil comprises an oil blend of ISO VG 10, ISO VG 68, ISO VG 150, or a combination thereof.

7. The lubricating grease of claim 4, wherein the thickener comprises lithium complex thickener.

8. The lubricating grease of claim 4, wherein the thickener comprises polyurea thickener.

9. The lubricating grease of claim 1 is configured to contribute to up to 10% power savings per lubricated component.

10. The lubricating grease of claim 1 is a National Lubricating Grease Institute (NLGI) #2 consistency grade.

11. The lubricating grease of claim 4, wherein the surface-active ester comprises an ester blend of KV 40=100 cSt, an ester blend of KV 40=200 cSt, an ester blend of KV 40=300 cSt, or a combination thereof.

12. The lubricating grease of claim 4, wherein
the thickener comprises lithium complex thickener of 10 wt. %;
the lubricating oil comprises ISO VG 10, API groups I, II, and/or V oil blend of 74.5 wt. %; and
the surface-active ester is 8 wt. %.

13. The lubricating grease of claim 4, wherein
the thickener comprises lithium complex thickener of 10 wt. %;
the lubricating oil comprises an oil blend of 74.5 wt. % comprising ISO VG 10, API group III oil and/or API group IV oil; and
the surface-active ester is 8 wt. % .

14. The lubricating grease of claim 4, wherein
the thickener comprises a polyurea thickener of 10 wt. %;
the lubricating oil comprises ISO VG 10, API groups I, II, and/or V oil blend of 74.5 wt. %; and
the surface-active ester is 8 wt. %.

15. The lubricating grease of claim 4, wherein
the thickener comprises a polyurea thickener of 10 wt. %;
the lubricating oil comprises an oil blend of 74.5 wt. % comprising ISO VG 10, API group III oil and/or API group IV oil; and
the surface-active ester is 8 wt. %.

16. A method of lubricating components in an electric vehicle, comprising applying a lubricating grease in the components in the electric vehicle, wherein the lubricating grease comprises:
a thickener in a range of 6% by weight (wt. %) to 12 wt. %;
a lubricating oil in a range of 57 wt. % to 92.98 wt. %, the lubricating oil consisting of synthetic oil selected from API groups III and IV; and
a surface-active ester in a range of 3 wt. % to 8 wt. %, the surface-active ester comprising a synthetic copolymer of alpha-olefins and dicarboxylic acids esterified with short to medium chain alcohols comprising about 3 to 12 carbon atoms, wherein the lubricating grease excludes a friction reducer and a modifier, an anti-wear agent, an extreme pressure agent, an oxidation inhibitor, and a corrosion inhibitor, and wherein the surface-active ester is an oil with a carbon backbone with two distinct side chains, the first side chain is hydrophobic, and the second side chain is polar.

17. The method of claim 16, wherein the components comprise wheel bearings, constant velocity joints, universal joints, electric motor bearings, or any combinations thereof.

* * * * *